United States Patent [19]

Thurner et al.

[11] Patent Number: 4,784,070

[45] Date of Patent: Nov. 15, 1988

[54] PANTIHOSE MANUFACTURE

[75] Inventors: Dietrich Thurner, Leinfelden-Echterdingen; Herman Schutzmeier, Immenstradt, both of Fed. Rep. of Germany

[73] Assignee: Detexomat Machinery Limited, Buckinghamshire, England

[21] Appl. No.: 903,257

[22] Filed: Sep. 3, 1986

[30] Foreign Application Priority Data

Sep. 10, 1985 [GB] United Kingdom ..... 8522438
Nov. 28, 1985 [GB] United Kingdom ..... 8529364

[51] Int. Cl.[4] ..... D05B 21/00

[52] U.S. Cl. ..... 112/121.12; 223/42; 223/112; 112/125.15; 112/306

[58] Field of Search ..... 112/121.15, 121.12, 112/306, 121.11; 223/43, 42, 112

[56] References Cited

U.S. PATENT DOCUMENTS

| | | | |
|---|---|---|---|
| 2,905,366 | 9/1959 | Shoaf . | |
| 3,520,262 | 7/1970 | Bolles et al. . | |
| 4,133,276 | 1/1979 | Selvi . | |
| 4,188,898 | 2/1980 | Bell, Jr. et al. . | |
| 4,196,681 | 4/1980 | Chietti . | |
| 4,364,320 | 12/1982 | Nakhle et al. | 112/121.15 X |
| 4,434,918 | 3/1984 | Hodges . | |
| 4,440,140 | 4/1984 | Hodges . | |
| 4,444,140 | 4/1984 | Moyer . | |
| 4,516,513 | 5/1985 | Gazzarrini . | |
| 4,532,875 | 8/1985 | Gazzarrini . | |
| 4,550,868 | 11/1985 | Hodges et al. | 112/121.15 X |
| 4,564,133 | 3/1986 | Gazzarrini . | |

FOREIGN PATENT DOCUMENTS

| | | | |
|---|---|---|---|
| 0126800 | 12/1984 | European Pat. Off. . | |
| 2211951 | 7/1974 | France . | |
| 168882 | 9/1984 | Japan | 112/121.15 |
| 2066862 | 7/1981 | United Kingdom . | |
| 2081316 | 2/1982 | United Kingdom . | |
| 2094616 | 9/1982 | United Kingdom . | |
| 2103257 | 2/1983 | United Kingdom . | |
| 21104564 | 3/1983 | United Kingdom . | |
| 2122654 | 1/1984 | United Kingdom . | |

OTHER PUBLICATIONS

"Takatori Line of Products"; ITMA '83.
Takatori Brochure to Model LC-240 Line Closer, undated.
Takatori Pair Closer Model TCR-2, Aug. 1983.
Takatori Auto Setter Model TAS-20, Sep. 1982.

*Primary Examiner*—H. Hampton Hunter
*Attorney, Agent, or Firm*—Dority & Manning

[57] ABSTRACT

For the manufacture of pantihose, a gusset inserting machine is coupled to a hosiery machine such as a boarding or toe closing machine, for automatic transfer or gussetted pantihose to the latter machine, by a first transfer mechanism which strips pantihose from the gusset machine and loads a rotary conveyor and by a second transfer mechanism which strips the pantihose from the conveyor and loads it on a pair of supports of the receiving hosiery machine. After the gusset machine has seamed a gusset into the pantihose, a support head on which the pantihose is mounted for gusset insertion is rotated through a predetermined angle for orienting the pantihose according to the loading requirements of the receiving machine, and the two transfer mechanisms and conveyor maintain the orientation of the pantihose as established by rotation of the support head.

26 Claims, 4 Drawing Sheets

PANTIHOSE MANUFACTURE

Figure 1:
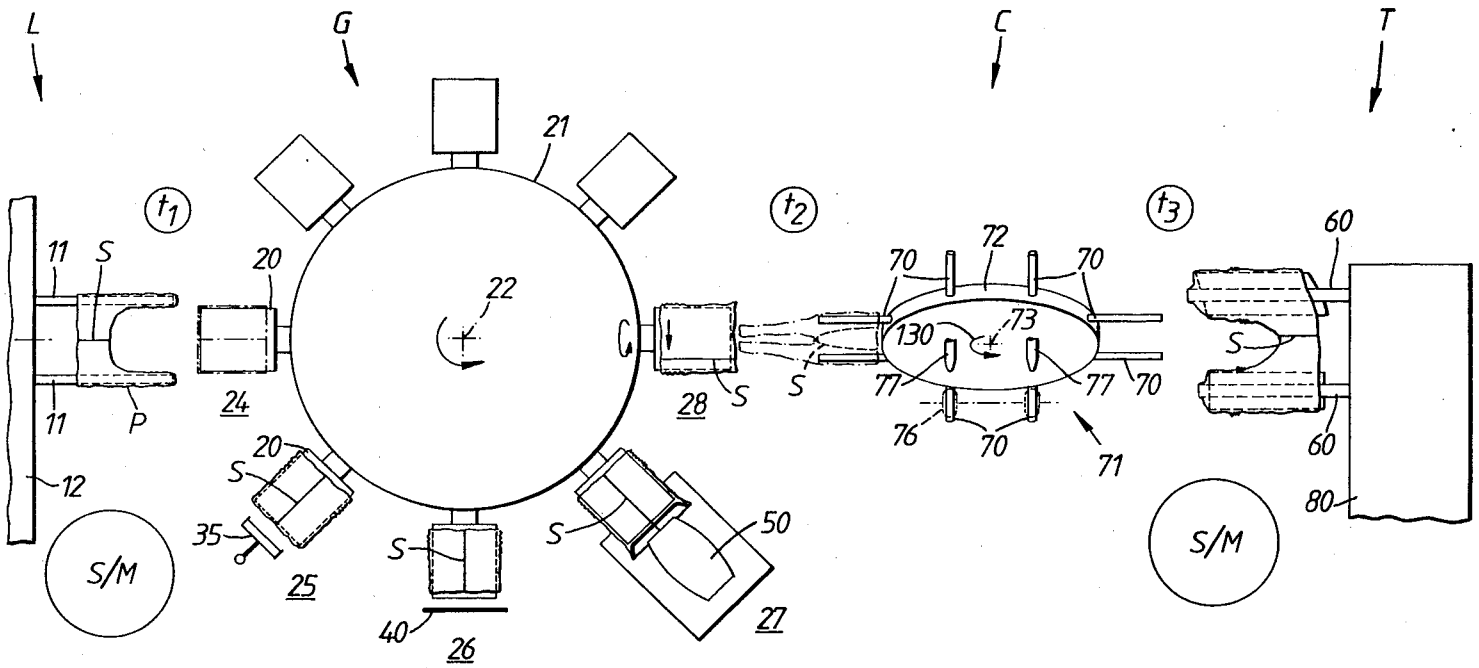

The present invention relates to the manufacture of pantihose, and more particularly to gussetted pantihose.

The traditional gussetted pantihose manufacturing routine involves a plurality of separate operations. First, tubular blanks are knitted on a circular knitting machine. Second, the blanks are assembled side-by-side, each is slit at one end and the slit edges are aligned and seamed together. This operation, commonly performed on a line closing machine, forms the body portion of the pantihose. Third, a gore piece or gusset is inserted and seamed into the crutch of the garment e.g. using a gussetting machine. Fourth, the free ends of the tubes (that form the legs) are closed by a toe closing seam. Fifth, the garment is usually boarded before packaging. At a convenient stage in the manufacturing process, the garment is dyed.

The sequence in which the foregoing operations are performed does not have to be as recited above. Although necessarily gusset insertion has to follow the line closing operation, toe closing may be accomplished before line closing or before gusset insertion.

Because the numerous operations are performed on dissimilar machines, the blanks have to be handled quite frequently, loading and unloading the machines. Each time they are handled, time is consumed and there is a significant risk of their being damaged. Current developments in the art seek to automate transfer between selected processing machines, but complete automation in this regard has not been attained hitherto.

Consider, for example, the operations of line closing, toe closing and gusset insertion. Performed separately, i.e. labour-intensively without mechanical aids for transfer between machines, one may toe close, then line close and then insert the gusset. Alternatively one may line close, then insert the gusset and then toe close. Traditionally, the toe-line-gusset sequence has been chosen by most pantihose manufacturers.

Automated transfer devices have been developed to reduce labour and "link" certain machines. Thus, line closers have been linked to toe closers (see e.g. Detexomat's EP-A-116,445). If a gussetted pantihose were required, the garment discharged from these linked machines has previously been loaded manually onto a gusset-inserting machine. Line closers have also been linked to gusset-inserting machines. Generally, tubular blanks are first loaded manually onto toe closers before they are transferred, normally by hand, onto a linked line closer and gusset inserting machine. In either case, of the three processes involving seaming (line, toe and gusset), gusset insertion has been the terminal process for various practical reasons.

In principle it is relatively easy to automate transfer from a line to a toe closer, where these machines have rather similarly-configured hose carriers operatively associated in pairs. It is not unduly difficult to automate transfer from a line closer to a gusset-inserting machine, despite their hose carriers being quite dissimilar. The line closer mounts the legs of the hose garment on two carriers and the gusset-inserting machine mounts the body of the garment in, or on, a single carrier. Transfer from two carriers to one carrier is fairly straightforward.

Practical problems stand in the way of automatically transferring from a single carrier to two carriers. For example, the garment is limp, and would somehow have to be persuaded to dispose itself properly for mounting on a pair of receiving carriers. Because of such and related problems, gusset insertion has been the terminal process in transfer-automated hosiery machine systems, and automatic transfer from a gusset machine for instance to a boarding machine has not been a practical possibility.

A common factor in existing transfer-automated hosiery machine systems has been the line closer. That is, the line closer has been linked either to a toe closer or to a gusset-inserting machine. Hosiery knitting machines are now being developed which produce a one-piece knitted pantihose garment. Such a garment is formed on the knitting machine with open-ended tubular legs linked together at the top to form the body of the garment, and the need for line closing is obviated. Present-day transfer-automated machine systems founded on line closers would be useless for the manufacturer equipped to produce the one-piece knitted garment.

We have been re-evaluating the hosiery manufacturing process and in particular ways of mechanically unloading hosiery from a gusset-inserting machine. We have devised an arrangement which can successfully transfer the garment from the gusset-inserting machine to another machine which demands that the garment be mounted with its legs drawn onto a pair of operatively-associated carriers, and, if needed, the garment can be re-oriented to suit the needs of the said other machine. Accordingly, gusset insertion no longer needs to be the terminal process performed on a transfer-automated machine system. In an automated system made feasible by the present invention, the gusset-inserting machine can now be linked e.g. to a receiving toe closer or to a receiving boarding machine. The resulting system is well suited for use with the above-mentioned one-piece knitted pantihose garment, although the system may include a line closer linked as an input to the gusset-inserting machine.

According to the present invention, there is provided in the manufacture of a pantihose garment, a method wherein the garment is mounted on a support body and a first manufacturing operation is performed on the thus-supported garment, the garment is transferred from said body to a pair of supports over which its legs are drawn and a second manufacturing operation is performed on the thus-supported garment, the body being placed in a given orientation on the pair of supports, thanks to a preliminary orienting manipulation of the garment before transfer commences.

Also according to the present invention, there is provided in the manufacture of a pantihose garment, the method involving the steps of mounting the garment on a gusset inserting machine, inserting a gusset, and transferring the garment from said machine to another machine having a pair of supports over which the garment and its legs are drawn, the garment being placed in a given orientation demanded by the said other machine on the latter, for example it is rotated lengthwise to place a medial plane thereof (e.g. a body seam) in a predetermined attitude to obtain the given orientation, while it is on the gusset inserting machine and preferably after the gusset insertion step. For example, the method can involve the steps of mounting the garment on a gusset inserting machine, inserting a gusset, and transferring the garment from said machine to another machine having a pair of supports over which the garment and its legs are drawn, and the garment is rotated lengthwise to place a medial plane thereof (e.g. a body seam) in a predetermined attitude after the gusset insertion step, so as to place it in a given orientation demanded by said other machine, the garment being rotated by a suitably controlled rotation of a support body of the gusset machine on which the garment is mounted for gusset insertion.

Further according to the present invention, there is provided pantihose manufacturing apparatus comprising a first machine having a support body to mount a pantihose garment while the first machine performs a first processing operation on the garment, a second machine having a pair of supports over which the garment and its legs are to be drawn prior to the second machine performing its processing operation on the garment, and means to strip the garment from the support body and to transfer it onto said pair of supports in a given orientation demanded by the second machine, the apparatus preferably including means to dispose the garment on the said support body in a given attitude related to said orientation before the stripping means operates to strip and transfer, the stripping means being operative in a manner such that the attitude of the garment is undisturbed.

The invention also provides pantihose manufacturing apparatus comprising a gusset inserting machine having a head for supporting the body of a pantihose garment while a gusset is inserted into a crutch area of the body, another machine for performing a hosiery manufacturing operation on the garment being operatively associated with the gusset inserting machine and having a pair of supports for receiving the garment and its legs after insertion of a gusset, and transfer means for stripping the garment from the gusset machine and for mounting it on the said pair of supports in a given orientation demanded by the said other machine, the gusset machine for example including means to rotate the garment about its lengthwise direction preferably after gusset insertion to place a medial plane thereof (e.g. a body seam) in a predetermined attitude so as to set the garment body to the given orientation.

A gusset inserting machine according to the present invention has a support head for a pantihose garment, the head being rotatably mounted, and means is provided to rotate the head through an angle predetermined to dispose the garment in a predetermined attitude immediately prior to the garment being stripped from the head for transfer to a receiving machine.

Figure 2:
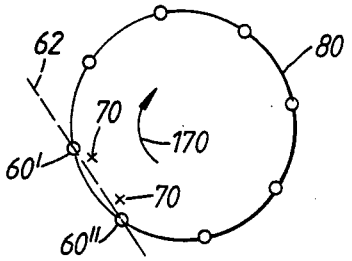
Figure 3:
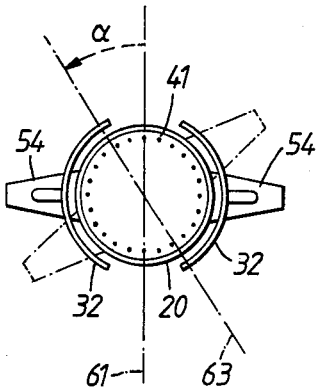
Figure 4:
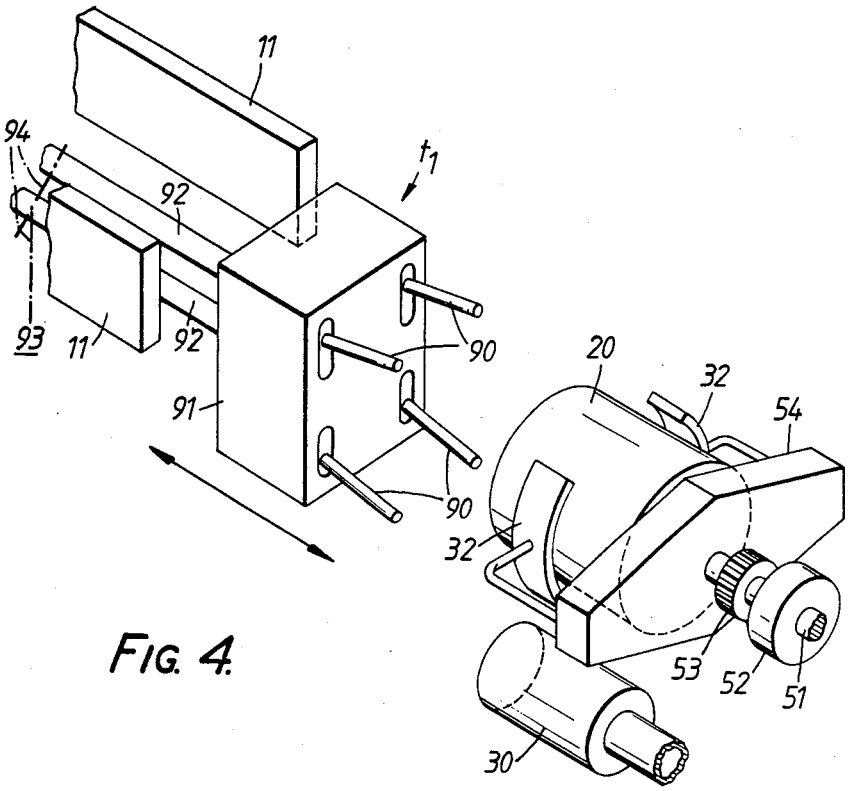
Figure 5:
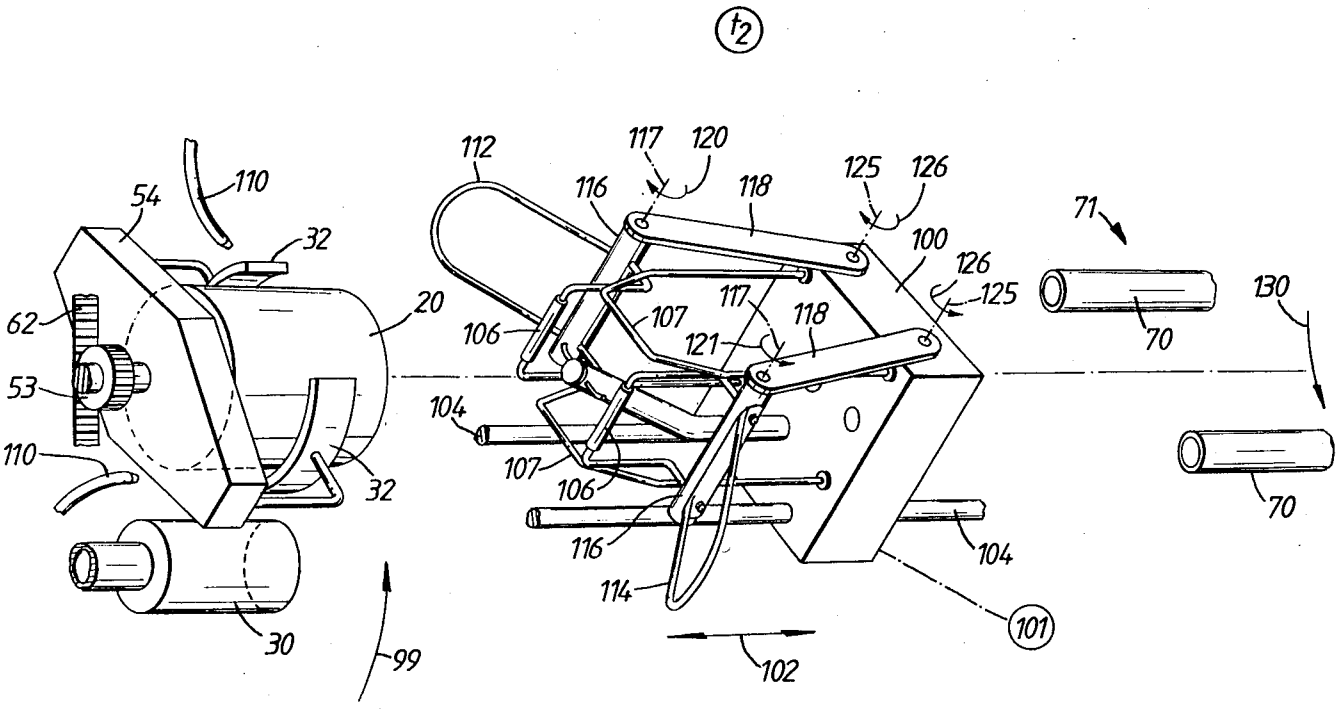
Figure 6:
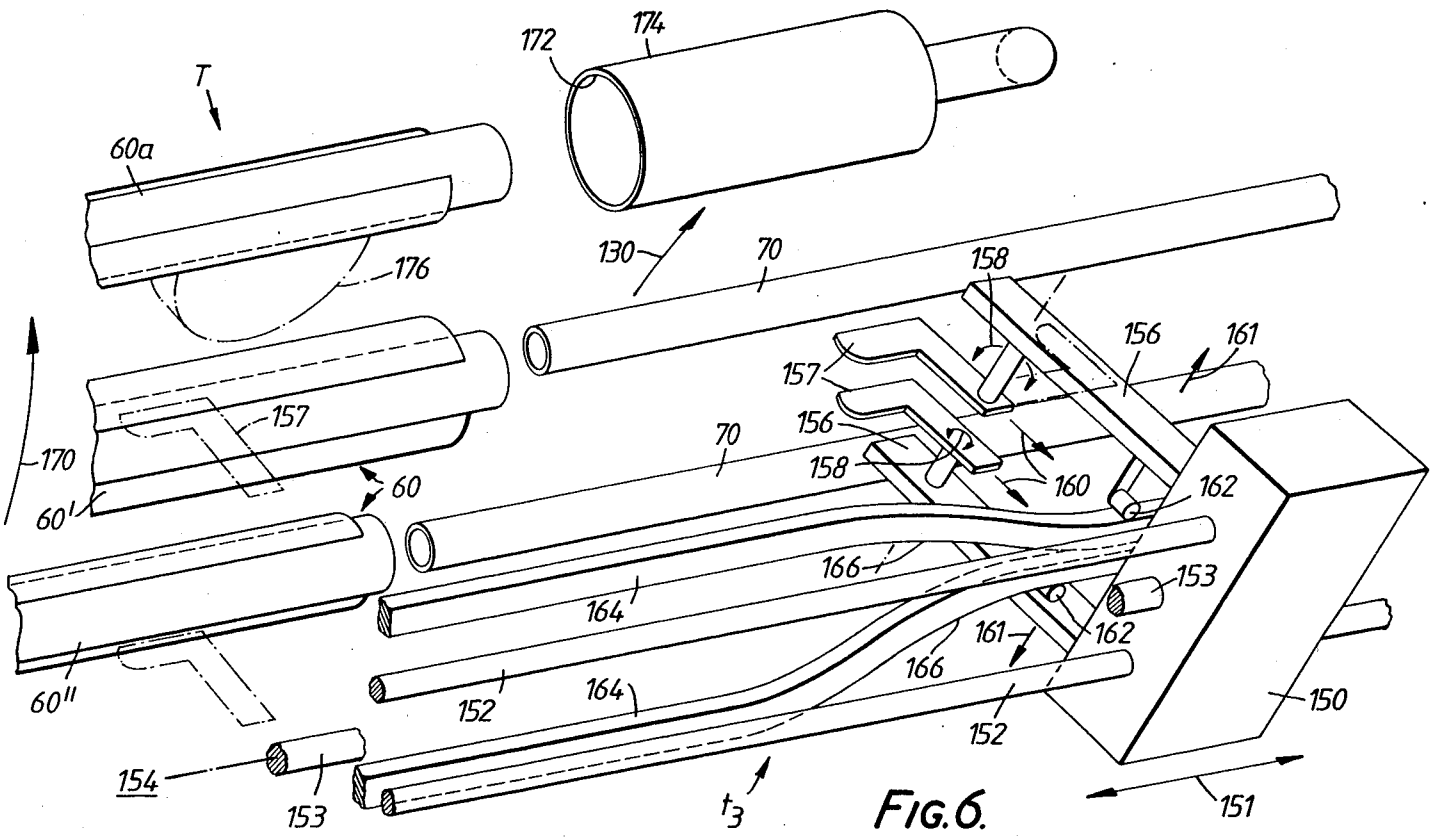

The invention will now be explained in more detail by way of example only with reference to the accompanying drawings, in which:

FIG. 1 is a schematic general plan view of pantihose production machinery according to the invention, FIG. 2 diagrammatically illustrates a toe closing operation, FIG. 3 is an end view of the head of a gusset-inserting apparatus, FIG. 4 schematically illustrates a mechanism for loading pantihose onto the head of the gusset-inserting apparatus, FIG. 5 schematically illustrates a mechanism for stripping gussetted pantihose from the said head and for loading it onto a transfer carousel, and FIG. 6 schematically illustrates a mechanism for transferring the pantihose from the transfer carousel to a toe closer.

The apparatus shown by way of example in the drawings is for use in manufacturing gussetted pantihose starting from open-ended tubular leg blanks. The processes performed by the apparatus involve several sealing operations. In sequence, the operations are line closing, gusset insertion and toe closing. As has been noted hereinbefore, and as will be described, the invention is not limited to apparatus comprising, in particular, a line closer, a gusset inserter and a toe closer.

Full details of the line closer 10 are omitted from this specification since line closers are well known in the art. Several types exist. One such line closer is made by Takatori Machinery Works Ltd. of Yamatotakeda City, Japan under several Model numbers, e.g. LC-240, LC-240, LC-280 and LC-320. See, for U.S. Pat. No. 4,303,026. Another well known line closer is the Savio Model TC developed by Savio & C S.P.A. of Milan, Italy. For the sake of illustration, the line closer 10 is a Savio Model TC machine.

The line closer 10 has a plurality of supports 11, for tubular hose blanks. The supports extend forwardly from a turret 12 which turns about a central, horizontally-disposed turning axis. The supports 11 extend parallel to the axis and move around an endless path, and during their movement they visit a loading station, a seaming station (neither illustrated for clarity), and an unloading station shown in FIG. 1. As the turret 12 turns, two adjacent empty supports 11 arrive at the loading station where each is loaded with a knitted, tubular hose blank. These two blanks are suitably slit, juxtaposed and seamed together by a seaming machine S/M such as a sewing machine, to form the pantihose body. The body seam S of the pantihose garment P is generated in a predetermined plane. Relative to the finished garment, this seam plane extends parallel to and equidistantly spaced between the garment legs when they are stretched out from the body in their usual side-by-side positions. The seam thus extends centrally from the garment waistband at the front, down through the crutch and centrally up to the garment waistband at the back.

After seaming, the garment P is moved still on its two supports 11 to the unloading station. The said plane of seam S is central between the two supports, extends parallel to their lengths and is normal to a plane containing both supports. The plane is in a vertical attitude at the unloading station.

At this station, a transfer mechanism $t_1$ is operative to strip the garment P from the line closer supports 11 and to load it on an unoccupied head 20 of a gusset inserting machine G. Mechanism $t_1$ will be discussed later with reference to FIG. 4.

Gusset inserting machines are known in the art and several kinds exist. The gusset machine illustrated is that manufactured and marketed by Detexomat Machinery Limited under the trade mark AUTOGUSSET. Further details are to be found in GB Nos. B-2,001,238 and B-2,058,856 and U.S. Pat. No. 4,220,104. The gusset machine G will now be described briefly.

The machine G has a horizontal turntable 21 which rotates intermittently about its central vertical axis 22, so as to move each of the heads 20 around an endless path. During their movement, the heads 20 pass in sequence through a series of work stations 24 to 28. The turntable rotates counterclockwise as indicated by the arrow in FIG. 1. The heads 20 are spaced equally apart around the periphery of the turntable 21 and each projects radially therefrom. The heads are cylindrical bodies and each is mounted to rotate about its radially-disposed central axis.

At station 24, a head 20 receives a pantihose garment P from line closer L via transfer mechanism $t_1$. The body of the garment is placed on the head such that the seam S remains in a vertical plane. Thus, the seam extends axially along the top and bottom of the head, vertically and diametrically across the outer end of the head. Only the body of the garment P is mounted on the head: the legs are sucked into a suction holding duct 30 (FIG. 4) and retained therein from the time the garment is placed on the gusset machine G until it is discharged therefrom. Once mounted, the garment body is firmly held in position on head 20 by a pair of inwardly-movable clamps 32.

At station 25, a hole cutter 35 is brought into engagement with the crutch area of the body, said crutch area being held tautly across the end of the head 20 by means of the clamps 32. The cutter 35 could be e.g. a hot wire or a sharp circular blade. By means of the cutter 35, a hole is formed in the crutch area ready for receiving a gusset. Once the hole is made, the clamps 32 move rearwardly to pull the apertured crutch area around the periphery of the head 20. That is, the end of the head is caused to pass through the hole by moving the garment body rearwardly with respect to the head 20.

At station 26, a gusset piece 40 is cut from a web of gusset fabric and presented to the end of head 20 by gusset holding means (not shown). Inside the end of the head is a ring of movable pins 41 (FIG. 3). The pins are axially movable from recessed to projecting positions relative to the end of the head, to project therefrom for the gusset piece to be impaled on them. Once a gusset piece 40 has been impaled on the pins 41, the latter are manipulated to cause each to incline forwardly and outwardly relative to the end of the head and its center. So inclined, the pins 41 prevent the gusset piece 40 from being inadvertently displaced from the pins.

The clamps 32 are then shifted forwardly a predetermined distance. This movement advances the edge of the hole in the crutch area towards and beyond the end of the head 20. The respective fabrics around the edges of the hole and the gusset piece are thereby brought into juxtaposition for seaming together, e.g. by overlock sewing.

At station 27, the juxtaposed fabrics are presented to a seamer 50, for instance an overlock sewing machine. The head 20 is now rotated about its central, radially-disposed axis. Thanks to the clamps 32 and the pins 41 the body and gusset piece 40 are rendered fast for rotation with the head 20. The seamer 50 generates the required seam joining the gusset piece to the body as the head rotates. In the illustrated example, the head is rotated through at least 360° for the single seamer provided to produce a wholly-encircling seam about the gusset piece periphery. If two coacting seamers were provided, as in some gusset-inserting machines, the head may be rotated through only about 180°.

The heads 20 are each fast with a shaft 51 (see FIG. 4) projecting rearwardly therefrom into a bearing, not shown, mounted on the turntable 21. A wheel 52 and pinion 53 are affixed to the shaft 51 and to this, also, is keyed a bracket 54 on which the clamps 32 are mounted. By means not shown, the suction holding duct 30 for the garment legs is mounted to rotate in unison with the associated head 20, to prevent twisting of the legs relative to the body. When each head 20 enters station 27, the wheel 52 is brought into engagement with a drive wheel (not shown) rotated by an electric motor controlled to cause the head 20 to rotate at a speed and for a period of time appropriate to generate the required seam and the required number of stitches per unit length.

At station 28, the garment P now having the gusset piece 40 seamed in place is discharged from the gusset machine G and transferred to the toe closer T with the aid of a rotary conveyor C.

For convenience, the gusset machine G is shown in FIG. 1 as having eight heads. There may be more or fewer. The AUTOGUSSET machine in fact has five heads which move in turn between the five stations illustrated.

It will be recalled that the line closer L established the seam S in a predetermined plane relative to the legs of the garment. Further, at the discharge position of the line closer L, the seam plane wa in a vertical attitude. The garment was transferred to and mounted on the head of the gusset machine G with the seam plane preserved in this vertical attitude.

The toe closer T is called upon to generate toe closing seal extending across the ends of the garment legs and located in a predetermined orientation relative to the body seam S. The precise orientation depends on the type of toe seam. With fish-mouth seams, for instance, their orientation is to be in a plane normal to the body seam. To ensure the toe seams are correctly oriented relative to the body seam S, the garment P first has to be mounted properly on a pair of toe closer supports 60, such that the body seam S is central between the supports 60. The plane of seam S should extend lengthwise parallel to the supports. Moreover, the seam S should lie in a plane normal to the plane containing the supports 60. (This, indeed, was the way in which the seam S was related to the supports 11 of the line closer.)

It may happen that, at the loading position of the toe closer T, a plane through the receiving supports 60 is neither horizontal nor vertical, see FIG. 2. A plane containing the supports 60', 60'' at the loading position is inclined at an appreciable angle shown by the dotted line 62. In the course of transferring the garment P from the gusset machine G to the toe closer T, the orientation of the garment P has to be adjusted to suit the toe closer.

So that the attitude of the seam plane matches the toe closer supports at the loading position, repositioning of the garment is accomplished in this example at station 28 on the gusset machine G. The head 20 is responsible for effecting the required reorientation, and means provided to transfer the garment P to the toe closer T is designed to preserve the attitude of the reoriented garment.

When the head 20 leaves the gusset seaming station 27, the wheel 51 is disengaged from the drive therefor and the head assumes a position such that the body seam S lies in a substantially vertical plane 61, see FIG. 3. The clamps 32 and their mounting bracket 54 are disposed generally horizontally, which disposition applied when the clamps first engaged the garment P upon its initial mounting on the head 20. Upon arrival of the head 20 at the discharge station 28, a rack 62, see FIG. 5, is caused to engage the pinion 53 on the shaft 51 secured to the head 20. The rack is displaced, e.g. by a ram, a specified distance adequate to rotate the pinion 53 (and hence the shaft 51, clamp bracket 54, clamps 32 and head 20) through a reorientation angle ($\alpha$) appropriate for positioning the seam plane to accord with the requirements for the toe closer. The attitude of the reoriented seam plane is indicated in FIG. 3 at 63, and the garment legs are appropriately oriented each for transfer onto the allotted toe closer support 60', 60''.

The garment P having been reoriented, a transfer mechanism $t_2$ to be described removes the body from head 20 and mounts it on conveyor C. To this end, mechanism $t_2$ pulls the body over a pair of adjacent supports, e.g. in the form of tubes 70, projecting from rotary conveyor means 71 towards the head 20. The conveyor means 71 is a circular carousel 72 which rotates about its center on a turning axis 73 inclined to the horizontal. The carousel 72 has several (four as shown) pairs of tubes 70 projecting from its rim and spaced equally thereabout. The tubes of each pair are mutually parallel. As will be seen, the pairs of tubes are aligned relative to two mutually perpendicular diameters of the carousel. A plane containing each pair of tubes 70 bears a definite angular relationship to the turning axis 73, and in this example all the tubes 70 lie in a common plane parallel to the plane of the carousel and normal to said axis 73.

The conveyor 70 rotates intermittently in the direction arrowed in FIG. 1, to move the tubes 70 having a garment P loaded thereon by mechanism $t_2$ to a position adjacent the toe closer supports 60 to receive the garment. In the latter position, another transfer mechanism $t_3$ serves to transfer the garment to the supports 60 from the conveyor 70. This mechanism $t_3$ will be described later The inclination of the carousel 72, and the arrangement of the tubes 70 thereon, are such that as each pair of tubes moves into position adjacent the two receiving toe closer supports 60, planes through these tubes and the two supports are parallel. See FIG. 2 where x—x represents the position of the tubes 70. Reorientation of the garment body by head 20 disposes the body seam S centrally relative to the two tubes 70 about to receive the garment P. The seam plane is normal to a plane containing these two tubes. The thus-oriented body is mounted on the tubes 70 in this orientation which is preserved as the tubes 70 move around into conjunction with the two receiving toe closer supports 60, so that the body will be presented thereto in this, the required orientation.

The transfer mechanism $t_2$ draws the garment only partially onto the receiving tubes 70. When the carousel rotates through 90°, and the tubes 70 are extending downwardly, a two wheel wind-on device 76 temporarily engages the body on the tubes 70. The device 76 winds the garment wholly onto the tubes, each leg being drawn fully over a respective tube. Two air jets from nozzles 77 then blow the garment legs towards the ends of the respective tubes 70 and suction is created in each. In the result, the garment body remains around the two tubes 70 and the legs extend along them and into their interiors. The leg portions inside the tubes are everted relative to the leg portions outside, and upon, the tubes.

The supports 70 do not have to be tubes to which suction is applied. It is feasible for the garment P to be mounted on a support of the carousel 72 such that the legs, or the lower parts thereof, dangle freely from the support. Supported in this way, transfer mechanism $t_3$ is capable of transferring the garment P from the carousel to the toe closer T and of loading the garment P properly on the toe closer.

The toe closer T can be of any known type, such as that manufactured and marketed by Detexomat Machinery Limited under the trade mark SPEEDOMATIC HS. See, for example, GB Nos. B-1,501,869; B-1,577,758; U.S. Pat. No. 4,192,242; GB-B-2,074,203 and U.S. Pat. No. 4,383,490. Since it is well known in the art full details will not be given here. The toe closer has a turret 80 rotatable intermittently about its central horizontal axis 81, in the direction indicated in FIG. 2. The supports 60 project from the turret 80. After receiving the pantihose garment from the transfer mechanism $t_3$, the toe closer indexes the supports around an endless path of travel and as they move, they pass through several work stations. At the various stations the following operations may be performed. At one station, the garment legs may be wound fully onto the supports 60. There or at the next station, the legs may be positioned automatically longitudinally and/or rotationally so that they are in a predetermined position and attitude permitting toe seams to be formed correctly thereacross. At another station, optionally, the toe ends of the garment legs are presented to a movable clamping device which conveys them in turn past a seamer S/M at the next station. At the seaming station, the toe ends are presented to and moved past the seamer S/M. Seams are generated across the toe end of each leg, e.g. by an overlock sewing machine. Following the seaming station is a discharge station. Here, the garment may be everted and conveyed, e.g. pneumatically, to a collection bin or to another hosiery processing machine in the manufacturing plant.

In the course of its passage through the apparatus, the garment P is everted or turned inside out and vice versa several times. Assuming the garment is right side out on the line closer, its body is turned inside out when being mounted on the gusset machine head 20. The body is turned right side out when mounted on the rotary conveyor C, while its legs are turned inside-out into the conveyor tubes 70 in readiness for the subsequent mounting on the toe closer supports 60. The body and legs are disposed inside out upon the supports 60.

If the garment is mounted on the support of conveyor C such that its legs dangle freely, see foregoing description, they will be everted inside out when drawn onto the toe closer supports 60 following mounting of the body thereon inside out.

Transfer mechanism $t_1$ is located and movable between the line closer supports 11. The mechanism has movable clamps or fingers which engage or grip the waistband of the garment P. See FIG. 4. Upper and lower reaches of the waistband encircling the line closer supports 11 are engaged by the clamps or fingers, which are manipulatable to open the waistband appropriately to pass it over the gusset machine head 20. As shown, the mechanism $t_1$ utilises fingers 90 pivotally mounted in a support body 91. Inside the body is camming means or the like for controlling the pivotal movement of the fingers 90 to ensure they open the waisband suitably. The body 91 is mounted on the ends of elongate arms 92 slidably mounted in bearings (not shown) for movement parallel to the aligned supports 11 and gusset head 20. Drive means 93 such as a pneumatic ram, camming mechanism or a ball screw device (similar to a machine lead screw device) has a drive connection 94 to the arms 92 for reciprocating them, the body 91 and fingers jointly through an operating cycle of the mechanism $t_1$. The operating cycle commences with the body 91 and fingers 90 in a starting position rearwardly of the waistband. The body and fingers are moved forwards (towards the gusset machine) to engage the fingers 90 with the waistband. During continuing movement of the body 91 and fingers, the latter are pivoted to open the waistband and move it, plus the adjoining body portion, over the gusset head 20. As the body is moved onto the head 20, the legs are sucked into duct 30. The forward movement of the fingers 90 terminates when they have moved the waistband to and beyond the location of the clamps 32 associated with the head 20. Drive means 93 then returns the body 91 and fingers 90 rearwardly to the starting position and the clamps 32 are then activated. The clamps move (i) inwardly to grip the garment body to the head 20 and (2) rearwardly relative to the head 20. The latter movement draws the crutch area taut across the end of the head. As has been discussed hereinbefore, the mechanism $t_1$ is designed to transfer the body from the line closer L to gusset machine G without disturbing the vertical attitude of the body seam S. For this purpose, it may be preferred for the mechanism $t_1$ to employ positively-acting clamps rather than fingers for the waistband. Preservation of the seam attitude may not be wholly essential, but it simplifies overall management of the operation of the apparatus.

FIG. 5 shows the transfer mechanism $t_2$ operable between the gusset machine 0 and the rotary conveyor C. Mechanism $t_2$ operates when head 20 has swung along horizontal path 99 into station 28 and two unoccupied tubes 70 of the conveyor 71 are aligned with the head 20, as indicated by the chain dotted line. The mechanism has a carriage 100 reciprocally movable between the head 20 and the tubes 70, suitable drive means 101 being coupled to move the carriage in the directions indicated by arrow 102. The drive means 101 can be any of the types suggested above for the transfer mechanism $t_1$. The carriage can be secured to movable arms 104 coupled to drive means 101. Alternatively, the carriage 100 can be movable to and from along fixed guide arms 104, when the drive means 101 is coupled to the carriage.

Adjacent wire frames are mounted on the carriage 100. Initially, frame components 106, 107 move with the carriage from the illustrated position into the mouth of the head 20. Frame components 106, 107 clamp the garment crutch area against an internal, diametrically-oriented face located just inside the mouth, against movement inadvertently from its reoriented attitude when the clamps 32 are next moved outwardly from clamping contact with the body. The apparatus is now ready for the garment body to be stripped from the head 20 and deposited on the transfer mechanism $t_2$. Stripping is accomplished by air jets from nozzles 110 and by retraction of the pins 41. The air jets blow the garment body from around the head to around the confronting wire frame components 106, 107, the body being everted in the process. In this example, the pins 41 are disengaged from the gusset piece when the body has been transferred onto the wire frame components.

If desired, a mechanical stripping means can be employed instead of air jets. Such stripping means can comprise fingers mounted to enter the waistband of the body mounted on the head 20 and to move the waistband forwards to place it and the garment body on the wire frame components. As before, the pins 41 are then retracted.

The said wire frames include respective frame components 112 and 114 flanking wire frame components 106. Frame components 106, 112 and 114 are mounted on associated vertical rods 116 pivoted to turn about their respective central axes 117 on link arms 118. Wire frame components 112, 114 project outwardly to "catch" or arrest the waistband as the garment is blown from the head 20 or is otherwise conveyed across to the wire frames. Means, not shown, are provided for pivoting the rods 116 so as to swing the wire components 112, 114 and also wire components 106 outwardly, in opposite directions. Arrows 120, 121 indicate these pivoting movements of the rods 116 and the said frame components. When the garment body has been displaced forwards by air jets or otherwise, the rods 116 are pivoted in opposite directions to cause their associated frame elements 106 to move apart, non-slippably to grip the garment waistband and stretch it. For the time being, the garment legs remain stored inside the suction duct 30.

Next, both rods 116 and frame components 106 are moved apart from one another, further stretching the waistband. This is accomplished by having the link arms 118 suitably pivoted about axes 125 on the carriage 100 and by operation of suitable drive means such as a ram (not shown); the link arms swing about the axes 125 in the directions of arrows 126. The frame components 106 are thus moved further apart, until they are spaced by a distance governed by, and which is not less than, the overall width across the two conveyor tubes 70. This opens the waistband sufficiently for it to be drawn about the two tubes 70. The carriage 100 then executes a transfer stroke by operation of drive means 101, the carriage and frame components 106 moving generally along the tubes to don the garment body thereon. At this time, suction may be relieved from the duct 30 to let the legs move outwards therefrom. At the end of the transfer stroke, the frame components 106 slip from the waistband, leaving the body stretched around the tubes 70. The carriage 100 can then be returned by drive means 101 to a position in readiness for transferring another garment. The return movement is along a path permitting the next pair of tubes to enter station 28 without fouling the carriage.

Once the body has been donned on the tubes 70, the conveyor 71 indexes in the direction of arrow 130. The garment legs now leave the duct 30, and wind-on device 76 is now activated as described above.

Before transfer from gusset machine G to conveyor C, therefore, the body is reoriented to suit the inclined attitude of the two receiving conveyor tubes 70. This attitude, which is matched to the inclination of the toe closer supports 60 ultimately to receive the garment, is preserved during operation of transfer mechanism $t_2$. Thanks to the reorientation, the seam is disposed properly for the conveyor C and toe closer T and the garment is so disposed that its legs will transfer smoothly onto the tubes 70 without any significant twist developing between the body and legs.

FIG. 6 shows the transfer mechanism $t_3$ operable between the rotary conveyor C and the toe closer T. When transfer is to occur, tubes 70 bearing a garment are generally aligned with toe closer supports 60′, 60″. The tubes 70 and supports 60 could be in exact alignment, i.e. coplanar and colinear. Then, transfer mechanism $t_3$ can be a simple design adaptation of transfer mechanism $t_1$. It may not be convenient to have the tubes 70 and supports 60 so exactly aligned, however. Mechanism $t_3$ is designed for the situation illustrated where the tubes 70 are closer together than the supports 60 and are in a different but parallel plane. The mutual positioning of tubes 70 and supports 60 is best appreciated from FIG. 2.

Mechanism $t_3$ has a carriage 150 movable, parallel alongside the tubes 70 and supports 60, in transfer or forward and return or rearward strokes. Its direction of travel is shown by arrow 151. Rails 152 guide the carriage in its travel. A push-pull rod 153 couples the carriage 150 to drive means comprising a pneumatic actuator 154 or some other drive means as suggested hereinbefore.

Two arms 156 project from the carriage 150 part-way towards the tubes 70. Pivotally mounted between the arms, one to each arm, are two L-shaped fingers or brackets 157. The fingers 157 are movable between retracted positions (shown dotted for one of them) and garment-engaging positions shown in solid lines. Pneumatic actuators, camming means or the like, not shown, may be employed to pivot the fingers in unison between their said positions. When moved to the garment-engaging positions (arrows 158) the forwardly cranked ends of the fingers 157 project between the tubes 70 to enter the top, waistband end of the garment. The fingers 157 may be moved to the garment-engaging positions before or shortly after the carriage 150 commences its transfer stroke, which is leftwards as seen in FIG. 6. Clearly, the fingers have to be positioned rearwardly beyond the waistband when they are moved to the garment-engaging positions.

The arms 156 are retractably mounted to the carriage 150. Alternatively, the fingers 157 are retractable along the arms towards the carriage. Pneumatic actuators, camming means or the like are activated for retraction after the fingers 157 have engaged the garment. Howsoever accomplished, the fingers are retracted from between the tubes 70 by a distance which is determined by the need for the fingers to draw the garment onto the toe closer supports 60, and hence is governed by the amount by which they are offset relative to tubes 70. See FIG. 2. The fingers are retracted (arrows 160) while the carriage is moving leftwards.

The supports 60 are spaced further apart from one another than the tubes 70. This necessitates a movement of the fingers 157 away from one another, until they are separated by a distance permitting them to travel freely along the supports 60. The fingers have to move in the direction of arrows 161. This movement is produced by displacing the arms 156 consequential upon the leftward travel of the carriage 150. The arms 156 are thus mounted to the carriage 150 for movement in the direction of arrows 161, and have followers 162 which ride on associated cam tracks 164. The two cam tracks 164 provide identical rises 166 in this instance. The cam rises are located to the right of the free ends of the supports 60 since the fingers must have attained the necessary separation by the time they reach the supports 60. The retraction and separation of the fingers are maintained as the carriage moves them leftwardly along the supports 60.

It will be observed that the respective ends of the tubes 70 and supports 60 are placed as close as practical to facilitate transfer of the garment body from one to another by means of the fingers 157.

Due to the close positioning of the tubes 70 and supports 60, and to the combined retraction and separation of the fingers 157, the latter are able to slip the garment body smoothly from the tubes 70 and onto the supports 60. The body only is transferred to the supports 60 : the legs remain inside the tubes 70. The body is everted as it is mounted on the supports 60 and the legs are already in an inside-out state inside their respective tubes 70.

At the end of the transfer stroke of carriage 150, the fingers are pivoted backwards (arrows 158) to slip them from the garment waistband. The carriage then executes its rightwards return stroke in the course of which the fingers 157 are restored to their starting positions in readiness for transferring the next garment to the toe closer T.

When the returning fingers and carriage have cleared the supports 60, the toe closer turret 80 indexes in the direction of arrow 170. In the course of this indexing movement, the garment legs are pulled partly from the tubes 70. Supports 60' and 60'' move to the positions of support **60*a* and support 60'. Support 60' is now located adjacent the mouth 172 of a suction tube 174 aligned therewith. Suction in tube 174 draws the leg to be mounted on support 60' wholly from tube 70 and into this tube. A wind-on device 176 is then engaged with the garment portion on support 60' and activated to draw the hose leg out of suction tube 174 and fully onto support 60. Thanks to suction in tube 174, the leg is de-twisted for proper mounting on support 60'. The operation is repeated when the turret 80 next indexes bringing support 60' opposite suction tube 174. It will be appreciated that the garment is mounted on the supports in an everted state, eversion being accomplished in two stages. The first stage everts the legs only, when the tubes 70 of conveyor 71 are in the intermediate position between their garment-receiving and garment-delivering positions. The second stage everts the body in the course of its mounting on the supports 60**.

If the conveyor C has garment supports which do not feature suction tubes 70, so that the legs dangle freely, eversion proceeds somewhat differently. Eversion of the body occurs when it is transferred onto the toe closer supports 60, and the legs are everted of their own accord as they are drawn onto their respective supports 60 following the body. With this arrangement, it may be desirable for the dangling legs initially to be sucked into the toe closer supports 60 before they are drawn onto the supports.

Once the garment and its legs have been fully drawn over the supports 60', 60'', the turret 80 indexes further and the toe closing operation proceeds as outlined hereinbefore.

The invention can be embodied in ways differing from what is described and illustrated. For example, if one starts with one-piece knitted garments, the line closer L will be omitted. The gusset machine G will then be loaded with said garments manually or automatically, and gusset insertion and toe closing will proceed as described.

Instead of having the toe closer linked downstream of the gusset machine G, a boarding machine could be substituted, such machine having one or more pairs of supports onto which the garment is to be drawn. A toe closer could be placed upstream of the gusset machine G in that case, the toe-closed garment being for instance automatically loaded on the machine G by a transfer device constructed along the lines of mechanism $t_1$. Hosiery processing apparatus could then comprise the following machines linked in sequence: line closer, toe closer, gusset machine and boarding machine. The line and toe closers could be transposed. Mechanisms similar to transfer mechanism $t_1$ link the two closers together and link the second closer to the gusset machine. Linking of the gusset machine to the boarding machine is by means of mechanism $t_2/t_3$ already described.

Conceivably, a boarding machine of turret type, could take the place of the rotary conveyor C, when only transfer mechanism $t_2$ would be needed.

In the illustrated apparatus, reorientation of the garment involved a substantial angular rotational displacement of the head 20. For example, the displacement is of the order of 45°–60°, for instance 54°. Such a large displacement would not always be necessary, depending on the toe closer or other machine downstream of the gusset machine G. The twin forms of the downstream machine might lie in a horizontal plane at their loading position. It might then be thought there would be no call for reorienting the garment body. However, it must be recognised that the gusset head is rotated through rather more than 360° or 180° during gusset seaming so there is a need for controllably rotating the head 20 after sealing to set the body seam accurately to an attitude suiting the downstream machine.

If one is working with one-piece knitted garments, there are of course no body seams—but there are discernable knitting structures so these garments still need orienting properly. In the foregoing description, references to the body seam plane and its attitude or orientation should be understood to refer to an equivalent medial plane through a one-piece garment if the invention is practised on such a garment.

For ease of illustration, the drawings have been simplified considerably; machinery embodying the principles of this invention may well look substantially different, therefore. To avoid over-complexity, the description has omitted details e.g. of the means which drive the various machine elements and which synchronise their operations. Such details will be readily within the knowledge of the hosiery machine designer having regard for the machines already in existence.

In the foregoing description, the equipment effects a rotation of the garment for aligning it appropriately with the two supports of the receiving machine, the latter supports being inclined appreciably to the horizontal. The need to rotate the garment could be avoided if the said supports were themselves in a different orientation, e.g. if the plane containing them were horizontal or vertical or otherwise if they were at an orientation matching the machinery upstream of the gusset machine. The garment will then be transferred from the gusset machine to the receiving machine in a manner whereby the garment is preserved in the orientation required by the receiving machine.

As disclosed hereinbefore, the illustrated line closer L has a turret rotating on a horizontal axis. When the pantihose garment is stripped from this line closer, the body seam is in a vertical plane. Line closers that have a carousel rotating about a vertical axis could also be used, e.g. any of the aforesaid Takatori machines. The body seam is then generated in a horizontal plane and the pantihose garment is stripped from such a line closer with the body seam horizontal.

The toe closer T disclosed above has a hose loading station wherein the two leg tubes or supports 60 to receive a pantihose garment lie in a common plane that is neither horizontal nor vertical. The toe closer could be adapted so that the plane of the leg tubes is e.g. horizontal at the loading position. The leg tubes will be thus when at "bottom dead centre". Such horizontally-disposed leg tubes will be well suited for operation with the illustrated line closer since the body seam will be in the vertical plane when stripped from the line closer and this is the attitude required then for loading the toe closer.

The toe closer could be adapted so that the leg tubes 60 lie in a vertical plane at the loading station. Vertically-disposed leg tubes are well suited for operation with Takatori line closers, because when they are loaded the body seam will be in a horizontal plane, and this is the attitude of the seam at the unloading or stripping position of the line closer.

By adapting the toe closer such that its loading station matches the line closer with regard to body seam attitude, operational simplification can be gained.

The gusset machine can be arranged whereby its head rotation is such that upon completion of the gusset seam, the pantihose garment has its body seam already in an attitude e.g. vertical or horizontal, matching the needs of the toe closer loading station. A deliberate, post-gussetting rotation of the gusset machine head to position the seam in the plane required by the toe closer can be eliminated. For example, suppose the gusset machine head 20 receives the garment P with the seam S horizontal, and the twin-support, receiving machine has its supports disposed for receiving the garment P with the seam in this attitude. Before gusset seaming, the head could be given a predetermined rotation in one rotational sense, and upon seaming is rotated in the opposite sense through this predetermined rotation plus 360°, ensuring a complete gusset seam is formed and returning the body seam S to the horizontal upon completion of the gusset seam.

Thus, as described the garment body is manipulated before transfer for placement in a given orientation on the twin supports of the receiving machine e.g. the toe closer and while it is still mounted on the preceding operation machine e.g. the gusset machine. The appropriate manipulation of the garment can be performed before or after the preceding operation machine has performed its designated task. The manipulation is conveniently performed by rotating the single support body on which the garment is mounted. However, the manipulation could be accomplished in other ways e.g. by rotating the garment on and relative to the said support body for instance by a rotary displacement of the clamps 32. After appropriate manipulation of the garment into the required attitude, this attitude is preserved and is maintained unaltered during transfer to the receiving machine.

Accordingly, the toe closer can be adapted such that its loading station is oriented to receive the pantihose garment with its body seam in the same attitude as it had at the line closer unloading station, and the gusset machine can be adapted to preserve this attitude at completion of the gussetting operation. By ensuring that the line closer and toe closer have their orientations appropriately matched, the operation of the gusset machine can be beneficially simplified.

Whatever the attitude of the leg supports of the machine to be loaded downstream of the gussetting machine, the tubes of the rotary conveyor C will be appropriately aligned with the said supports.

Various changes and modifications will readily occur to the addressee and such are within the spirit and scope of the invention disclosed herein.

Hosiery processing apparatus according to this invention can comprise a plurality of hosiery processing machines each to perform a designated operation on pantihose articles, the machines being linked by automatic transfer mechanism such that said articles are transferred from one machine to the next and are mounted thereby on the latter. In a series of machines linked by automatic transfer mechanism, some, but not necessarily all of the machines will perform seaming operations on the pantihose articles. The apparatus according to the invention can comprise, for example, the following linked machines arranged in the following order:

(a) gusset machine - toe closer
(b) gusset machine - boarding machine
(c) line closer - gusset machine - toe closer
(d) line closer - gusset machine - boarding machine
(e) line closer - toe closer - gusset machine - boarding machine
(f) toe closer - line closer - gusset machine - boarding machine
(g) line closer - gusset machine - toe closer - boarding machine
(h) gusset machine - toe closer - boarding machine.

We claim:

1. Pantihose manufacturing apparatus including a gusset inserting machine having a support body for mounting a pantihose garment for said machine to perform a gusset inserting operation on the garment, a second machine having support means over which legs of said garment are to be drawn prior to initiating a processing operation on said garment by the second machine and means to strip the garment from the support body and to transfer it onto said support means in a given orientation demanded by the second machine, said apparatus further having means adapted and operational to dispose the garment in a predetermined attitude related to said given orientation before said stripping means is activated to strip and transfer the garment, said stripping means being operative to preserve said attitude.

2. Apparatus according to claim 1, which comprises means to rotate the garment about its lengthwise axis to place a medial plane thereof in the predetermined attitude so as to dispose the said plane in the given orientation.

3. Apparatus according to claim 2, wherein the garment rotating means is operational to dispose said garment in said predetermined attitude subsequent to gusset insertion.

4. Apparatus according to claim 2, wherein the garment rotating means comprises said support body which is rotatable and means controllable to rotate the body for setting the garment thereon in the said predetermined attitude.

5. Apparatus according to claim 2, wherein said second machine includes means to perform a seaming operation on said garment.

6. Pantihose manufacturing apparatus comprising a gusset inserting machine provided with a head for supporting the body of a pantihose garment for a gusset to be inserted into a crutch area of the body; a second machine for performing a hosiery manufacturing operation on the garment being operatively associated with the gusset inserting machine, the second machine being provided with support means for receiving the garment after insertion of a gusset; transfer means for stripping the garment from the gusset machine and for mounting it on said support means in a given orientation demanded by said second machine, the gusset machine including means to rotate the garment about its lengthwise direction to place a medial plane thereof in a predetermined attitude related to the given orientation, and said transfer means being operative to preserve said attitude during operation of said transfer means.

7. Apparatus according to claim 6, wherein the rotating means is operative to dispose said garment in the predetermined attitude following insertion of a gusset by said gusset-inserting machine.

8. Apparatus according to claim 6, wherein the rotating means comprises the said head, which is rotatable, and means for controllably rotating the head and hence the garment into the said orientation prior to transfer of the garment from the gusset inserting machine.

9. Apparatus according to claim 6, further including a hosiery seam generating machine, a transfer mechanism operable to transfer the garment from said seam generating machine to the gusset inserting machine, the said mechanism being operable to strip the garment from said seam generating machine and to place it on the gusset inserting machine head in a manner preserving an orientation possessed by the garment immediately before transfer to said gusset inserting machine and the garment rotating means of said gusset inserting machine being operable to rotate the garment by a predetermined amount to attain said given orientation, prior to engagement of said transfer means with the garment for transfer to said second machine.

10. Apparatus according to claim 6 wherein the said support means are part of a conveyor mechanism operable, after the garment has been drawn over said support means to perform a conveying operation.

11. Apparatus according to claim 6, wherein the said support means are part of a toe closer operable, after the garment has been drawn over said support means to perform a toe closing operation.

12. Apparatus according to claim 6, wherein the said support means are part of a boarding machine operable, after the garment has been drawn over said support means to perform a boarding operation.

13. Apparatus according to claim 6, wherein said transfer means comprises a rotatable conveyor located between said gusset inserting machine and said second machine, said rotatable conveyor including a plurality of pairs of supports, said plurality of pairs of supports being oriented to substantially the same attitude as said support means on said second machine, a transfer mechanism for stripping said garment having a gusset inserted therein from said gusset inserting machine and mounting same on one of said pairs of supports, and a transfer mechanism for stripping said garment from said pair of supports and mounting same on said support means.

14. Apparatus according to claim 1 comprising plurality of hosiery processing machines including a line closer, a toe closer and a gusset inserting machine, automatic means to transfer a garment onto the gusset inserting machine from one of said machines and means to transfer the garment from the gusset inserting machine to the support means said a second machine, the gusset inserting machine being operable to dispose the garment in said predetermined attitude.

15. Apparatus according to claim 14, wherein said second machine is spaced from the gusset inserting machine, said support means are inclined at a given angle to the horizontal; and a rotary conveyor having a pair of supports is provided to carry the garment from the gusset inserting machine to said support means of the second machine; the supports of said conveyor are inclined at substantially the same angle to the horizontal as the supports of the second machine for aligning substantially therewith; and said gusset inserting machine has means to rotate the garment through an angle related to said given angle; first and second transfer mechanisms being provided the first to transfer the garment from the gusset inserting machine to said conveyor and the second to transfer it from the latter to said second machine, said two transfer mechanisms being operable to transfer the garment as aforesaid while preserving the orientation thereof established by operation of said rotating means.

16. A machine for inserting gussets into the crutches of pantihose garments, comprising:

a rotary carrier, a plurality of pantihose support members each mounted on said carrier to rotate relative thereto, means to rotate said carrier to move said support members, in turn, successively between a plurality of stations including a garment loading station, a gusset inserting station and a garment unloading station, means to assemble gusset pieces with the crutches of the garments to be processed by the machine, at said gusset inserting station, a sealing device for joining together a gusset piece assembled with each garment mounted on a respective support member, means to rotate said support members relative to said carrier at the gusset inserting station while said seaming device is operative, thereby to generate seams around the gussets and join same to the associated garments, means at the gusset unloading station to strip the garments having gusset pieces inserted therein from the support members when each member is moved to the unloading station, said machine further including means to rotate each support member through an angle predetermined to dispose the garment in a predetermined attitude prior to the garment being stripped from the support member for transfer to a receiving machine.

17. A machine according to claim 16, wherein said garment stripping means is a transfer mechanism operable to transfer successive pantihose garments to a toe closing machine and mount them on same while preserving the garments in the predetermined attitude established prior to stripping them from their support members.

18. Pantihose manufacturing apparatus, comprising at least three serially-arranged hosiery processing machines operative to perform respective processing operations in sequence on pantihose articles supplied to the apparatus, automatic transfer mechanism operable between pairs of said machines for conveying said articles from one machine to the next machine in the series and for mounting said articles on same one of the machines demanding that said articles be mounted thereon in a given orientation, gusset inserting machine in the series preceding said one machine and having means to orient said articles in a predetermined attitude corresponding to the given orientation, said apparatus and transfer mechanism being operative to maintain said oriented articles in the predetermined attitude corresponding to the given orientation, until they have been mounted on said one machine.

19. Apparatus according to claim 18, wherein said orienting means comprises a pantihose support head of said gusset inserting machine, said head being rotatable and means being provided to rotate said head through such angle as required to dispose a pantihose article in the predetermined attitude.

20. Apparatus according to claim 18, wherein the gusset inserting machine performs a seaming operation and at least one of the other machines also performs a seaming operation on the pantihose articles.

21. Apparatus according to claim 18, wherein the machines in the series include firstly a hosiery line closer, a gusset inserting machine, and lastly a toe closing machine.

22. Apparatus according to claim 18, wherein the machines in the series include firstly a hosiery line closer, a gusset inserting machine and lastly a boarding machine.

23. Apparatus according to claim 18, wherein the machines in the series include firstly a hosiery line closer, a toe closer, a gusset inserting machine and lastly a boarding machine.

24. Apparatus according to claim 18, wherein the machines in the series include firstly a toe closer, a hosiery line closer, a gusset inserting machine and lastly a boarding machine.

25. Apparatus according to claim 18, wherein the machines in the series include firstly a gusset inserting machine, a toe closing machine and lastly a boarding machine.

26. Apparatus according to claim 18, wherein the machines in the series include firstly a toe closing machine, a gusset inserting machine and lastly a boarding machine.

* * * * *